US005916842A

United States Patent [19]

Morimitsu et al.

[11] Patent Number: 5,916,842

[45] Date of Patent: Jun. 29, 1999

[54] THERMAL DYE TRANSFER SHEET AND METHOD FOR THERMAL DYE RECORDING

[75] Inventors: Tatsuya Morimitsu; Kenjiro Kuroda; Osamu Ito, all of Tokyo; Takashi Morishima, Yokohama, all of Japan

[73] Assignees: Mitsubishi Chemical Corporation; Toppan Printing Co., Ltd., both of Tokyo, Japan

[21] Appl. No.: 08/839,804

[22] Filed: Apr. 18, 1997

[30] Foreign Application Priority Data

| | | | |
|---|---|---|---|
| Apr. 19, 1996 | [JP] | Japan | 8-098722 |
| Dec. 20, 1996 | [JP] | Japan | 8-341316 |
| Dec. 24, 1996 | [JP] | Japan | 8-343874 |
| Dec. 24, 1996 | [JP] | Japan | 8-343880 |

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS

| | | | |
|---|---|---|---|
| 4,866,029 | 9/1989 | Evans et al. | 503/227 |
| 5,561,098 | 10/1996 | Ikemoto | 503/227 |

FOREIGN PATENT DOCUMENTS

| | | |
|---|---|---|
| 0 332 924 | 9/1989 | European Pat. Off. . |
| 0 368 630 | 5/1990 | European Pat. Off. . |
| 2 363 450 | 3/1978 | France . |
| 5-35079 | 5/1993 | Japan . |

OTHER PUBLICATIONS

Database WPI, Section Ch, Week 9043, Derwent Publications Ltd., London, GB; XP002051023, Sep. 14, 1990.

Chemical Abstracts, vol. 109, No. 26, Dec. 26, 1988, Columbus, OH, US; Abstract No. 24066, Koichi Kudo, et al: "Organic electrophotographic photoreceptor with insulating top layer containing light–absorbing dye", XP002051021.

Chemical Abstracts, vol. 109, No. 26, Dec. 26, 1988, Columbus, OH,US, Abstract No. 240662, Koichi Kudo, et al: "Organic electrophotographic photoreceptor with photosensitive layer containing light–absorbing dye", XP002051022.

*Primary Examiner*—Bruce H. Hess

*Attorney, Agent, or Firm*—Oblon, Spivak, McClelland, Maier & Neustadt, P.C.

[57] ABSTRACT

A thermal dye transfer sheet having a dye layer provided on at least one side of a substrate, which is used for thermal dye transfer recording system carrying out recording by transferring a dye or dyes in the dye layer to a dye-receiving material by heating means, wherein the dye layer contains a pyrazolonemethine type dye of the following formula:

(1)

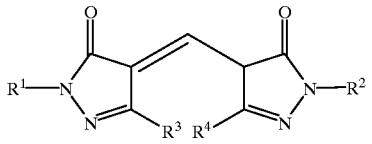

wherein $R^1$ and $R^2$ can be respectively independently selected and are a lower alkyl group which may be substituted, a lower alkenyl group which may be substituted or an aryl group which may be substituted; and $R^3$ and $R^4$ can be respectively independently selected and are a lower alkyl group which may be substituted, a dialkylamino group, a —$COOR^5$ group or a —$CONR^6R^7$ group, in which $R^5$ is a lower alkyl group which may be substituted, a lower alkenyl group which may be substituted or an aryl group which may be substituted and $R^6$ and $R^7$ can be respectively independently selected and are a hydrogen atom, a lower alkyl group which may be substituted, a lower alkenyl group which may be substituted or an aryl group which may be substituted.

19 Claims, No Drawings

THERMAL DYE TRANSFER SHEET AND METHOD FOR THERMAL DYE RECORDING

The present invention relates to a thermal transfer sheet used for a color hard copy by thermal transfer recording system, and particularly relates to a thermal dye transfer sheet used by thermal dye transfer recording system.

Recently, as a system for developing an image on a display such as CRT or the like as a hard copy, there is widely used a thermal dye transfer recording system which comprises heating a thermal dye transfer sheet with a thermal head, the heat generation of which can be controlled by an electric signal, transferring a dye only in a dye layer of the thermal dye transfer sheet and forming the transferred image on an image-receiving sheet. Generally, this system employs a thermal dye transfer sheet having a dye layer comprising a dye and a binder resin coated on a substrate. A full color image can be formed by overlapping a yellow image from a yellow dye layer, a magenta image from a magenta dye layer and a cyan image from a cyan dye layer.

Examples of a thermal transfer recording system include a melting dye transfer recording system which comprises melting a dye layer which contains a dye and a wax, on a substrate by heating and transferring the melted dye and wax to a dye-receiving material and a thermal dye transfer recording system which comprises transferring a dye only from a dye layer to an image-receiving material. The thermal dye transfer recording system is suitable for obtaining a full color print having a density gradation expression and also suitable for obtaining a precise image since it can control an amount of a dye to be transferred by controlling an amount of heat.

An important point of a thermal dye transfer recording system is to form an image having satisfactory color reproducibility, sensitivity, coloring density and fastness such as light-resistance. Thus, the thermal dye transfer sheet is demanded to achieve a faithful color reproducibility of an original image, to provide a sufficient color-developing property (high sensitivity) and a sufficient coloring density (high optical density) by a small heat energy, and to form an image having a satisfactory fastness, and also demanded to have a satisfactory shelf life.

However, a conventional thermal dye transfer sheet does not always satisfy all of these demanded properties.

The present invention has been made to solve the above-mentioned conventional problems. Thus, an object of the present invention is to provide a thermal dye transfer sheet, particularly excellent in thermal yellow color dye transfer recording, which forms an image having a faithful color reproducibility of an original image and also having a high fastness such as a high light-resistance, and which achieves a sufficient color-developing property (high color-developing sensitivity) and a sufficient coloring density by a small heat energy, and also which has satisfactory shelf life.

In order to solve the above-mentioned problem, the present invention provide a thermal dye transfer sheet having a dye layer comprising at least one dye and a binder resin provided on a substrate sheet, characterized in that the dye layer contains at least one pyrazolonemethine type dye of the following formula (1)

(1)

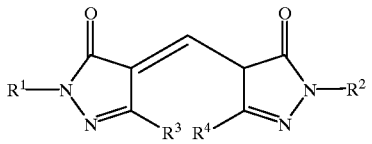

wherein $R^1$ and $R^2$ can be respectively independently selected and are a lower alkyl group which may be substituted, a lower alkenyl group which may be substituted or an aryl group which may be substituted; and $R^3$ and $R^4$ can be respectively independently selected and are a lower alkyl group which may be substituted, a dialkylamino group, a —$COOR^5$ group or a —$CONR^6R^7$ group, in which $R^5$ is a lower alkyl group which may be substituted, a lower alkenyl group which may be substituted or an aryl group which may be substituted, and $R^6$ and $R^7$ can be respectively independently selected and are a hydrogen atom, a lower alkyl group which may be substituted, a lower alkenyl group which may be substituted or an aryl group which may be substituted.

Another object of the present invention is to provide a thermal dye transfer sheet, characterized by containing a pyrazolonemethine type dye of the formula (1) and a pyrazoloneazo type dye.

Other object of the present invention is to provide a thermal dye transfer sheet, characterized by containing a pyrazolonemethine type dye of the formula (1) and a quinophthalone type dye.

Still other object of the present invention is to provide a thermal dye transfer sheet, characterized in that a plurality of dye layers are provided on one side of a substrate and at least one of the dye layers contains the pyrazolonemethine type yellow dye and at least one other dye layer contains an indoaniline type cyan dye.

As a result of various studies and experiments, the present inventors have found that an image recording having a faithful color reproducibility of an original image, achieving a satisfactory coloring (high sensitivity) and a high coloring density by a low heat energy and having a satisfactory fastness, can be achieved by using a dye layer for thermal dye transfer recording, which contains at least one of (1) a pyrazolonemethine type dye having the above-mentioned specific chemical structure, (2) a mixture of a pyrazolonemethine type dye and a pyrazoloneazo type dye, and (3) a mixture of a pyrazolonemethine type dye and a quinophthalone type dye.

The thermal dye transfer sheet of the present invention comprises a substrate and a dye layer provided at least one side of the substrate. If necessary, the heat-resistant layer may be provided on the opposite side of the dye layer side of the substrate.

The substrate is selected in view of mechanical strength, easy handling or convenience for formation of a dye layer, examples of which include paper such as condenser paper, polyethylene terephthalate film, polyamide film, polyaramide film, polyimide film, polycarbonate film, polyphenylene sulfide film, polysulfone film, cellophane, triacetate film, polypropylene film, and the like. Among them, polyethylene terephthalate film is preferable in view of mechanical strength, size stability, heat-resistance, price and the like, a biaxially oriented polyethylene terephthalate film is particularly preferable. These substrates have a thickness of generally from 1 to 30 $\mu$m, preferably from 2 to 10 $\mu$m.

In order to improve adhesiveness of a dye layer to a substrate, the surface of a substrate may be subjected to corona-treatment, or may be provided with an anchor coat of polyester type resin, cellulose type resin, polyvinyl alcohol type resin, urethane resin, polyvinylidene chloride type resin or the like.

A dye contained in a dye layer is preferably at least one of (1) a pyrazolonemethine type dye of the formula (1)

(1)

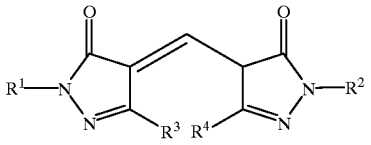

wherein $R^1$ and $R^2$ can be respectively independently selected and are a lower alkyl group which may be substituted, a lower alkenyl group which may be substituted or an aryl group which may be substituted; and $R^3$ and $R^4$ can be respectively independently selected and are a lower alkyl group which may be substituted, a dialkylamino group, a —$COOR^5$ group or a —$CONR^6R^7$ group, in which $R^5$ is a lower alkyl group which may be substituted, a lower alkenyl group which may be substituted or an aryl group which may be substituted and $R^6$ and $R^7$ can be respectively independently selected and are a hydrogen atom, a lower alkyl group which may be substituted, a lower alkenyl group which may be substituted or an aryl group which may be substituted;

(2) a mixture of the above pyrazolonemethine type dye and a pyrazoloneazo type dye; and (3) a mixture of the above pyrazolonemethine type dye and a quinophthalone type dye.

In the substituents of the pyrazolonemethine type dye of the formula (1), the term "lower" means "$C_1$–$C_8$" (number of carbon atoms=from 1 to 8).

$R^1$ and $R^2$ are respectively independently selected, and are a lower alkyl group which may be substituted, a lower alkenyl group which may be substituted or an aryl group which may be substituted; and $R^3$ and $R^4$ are respectively independently selected, and are a lower alkyl group which may be substituted, a dialkylamino group, a —$COOR^5$ group or a —$CONR^6R^7$ group, in which $R^5$ is a lower alkyl group which may be substituted, a lower alkenyl group which may be substituted or an aryl group which may be substituted, and $R^6$ and $R^7$ are respectively independently selected and are a hydrogen atom, a lower alkyl group which may be substituted, a lower alkenyl group which may be substituted or an aryl group which may be substituted.

Preferably, $R^1$ and $R^2$ are respectively independently selected, and are a lower alkyl group, a phenyl group which may be substituted or an aralkyl group, and $R^3$ and $R^4$ are respectively independently selected, and are a lower alkyl group or a —$COOR^5$ group in which $R^5$ is a lower alkyl group, a phenyl group which may be substituted or an aralkyl group.

More preferably, $R^1$ and $R^2$ are respectively independently selected, and are a lower alkyl group, a phenyl group which may be substituted with a methyl group, methyl groups, a halogen atom, halogen atoms or a benzyl group, and $R^3$ and $R^4$ are respectively independently selected and are a lower alkyl group or a —$COOR^5$ in which $R^5$ is a lower alkyl group, a phenyl group which may be substituted with a methyl group or a halogen atom, or a benzyl group.

Still more preferably, $R^1$ and $R^2$ are respectively independently selected, and are a phenyl group or a tolyl group, and $R^3$ and $R^4$ are methyl groups.

The pyrazolonemethine type dye of the formula (1) wherein $R^1$ and $R^2$ are phenyl groups and $R^3$ and $R^4$ are methyl groups, is known as C.I. Solvent Yellow 93, and is most preferable among the dyes used in the present invention for yellow recording by thermal sublimable dye transfer recording.

The pyrazoloneazo type dye is preferably a pyrazoloneazo type dye of the following formula (2):

(2)

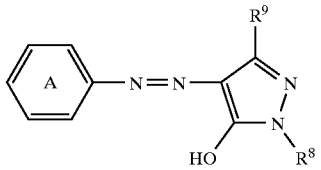

wherein A is a phenyl group which may be substituted, $R^8$ is a lower alkyl group which may be substituted, a lower alkenyl group which may be substituted or an aryl group which may be substituted, and $R^9$ is a lower alkyl group which may be substituted or —$COOR^{10}$ group in which $R^{10}$ is a lower alkyl group which may be substituted, a lower alkenyl group which may be substituted or an aryl group which may be substituted. In these substituents, the term "lower" means "$C_1$–$C_8$". Preferably, a substituent for A is respectively independently selected, and is a hydrogen atom, a fluorine atom, a chlorine atom, a bromine atom, a nitro group, a cyano group or a methyl group and they may be plurally present, and $R^8$ is a lower alkyl group or a phenyl group which may be substituted with a halogen atom, halogen atoms, a methyl group or methyl groups, and $R^9$ is a methyl group.

The pyrazoloneazo type dye of the formula (2) wherein A is a phenyl group, $R^8$ is a phenyl group and $R^9$ is a methyl group, is known to be as C.I. Solvent Yellow 16, and is most preferable among the dyes used in the present invention, as a pyrazoloneazo type dye to be contained in a dye layer, together with a pyrazolonemethine type dye of the formula (1).

The most preferable combination of a pyrazolonemethine type dye and a pyrazoloneazo type dye used in the present invention is a combination of a pyrazolonemethine type dye of the formula (1) wherein $R^1$ and $R^2$ are respectively independently a phenyl group or a tolyl group and $R^3$ and $R^4$ are methyl groups and a pyrazoloneazo type dye of the formula (2) wherein a substituent for A is selected from the group consisting of a hydrogen atom, a chlorine atom and a methyl group and they may be plurally present, and $R^8$ is a $C_3$–$C_8$ alkyl group, a phenyl group or a tolyl group, and $R^9$ is a methyl group. Most preferably, a combination of C.I. Solvent Yellow 93 and C.I. Solvent Yellow 16.

With regard to a quinophthalone type dye used in combination with a pyrazolonemethine type dye of the present invention, any dye may be usable as far as it satisfies the aimed object of the present invention.

Particularly, a quinophthalone type dye of the following formula (3) is preferable.

(3)

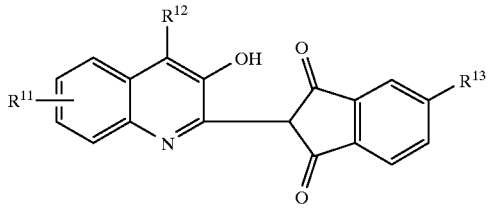

In the above formula, $R^{11}$ is a hydrogen atom, a lower alkyl group which may be substituted, a halogen atom, an alkoxy group or an alkoxycarbonyl group, $R^{12}$ is a hydrogen atom, a halogen atom, an alkoxy group or a phenoxy group which may be substituted, and $R^{13}$ is halogen atom, a —$COOR^{14}$ group or a —$CONR^{15}R^{16}$ group, in which $R^{14}$ is an alkyl group which may be substituted, a lower alkenyl group which may be substituted or an aryl group which may be substituted, and $R^{15}$ and $R^{16}$ are respectively a hydrogen atom, a lower alkyl group which may be substituted, a lower alkenyl group which may be substituted or an aryl group which may be substituted, provided that $R^{15}$ and $R^{16}$ are not hydrogen atoms at the same time. In the above definition, the term "lower" means" "$C_1$–$C_8$".

A preferable dye of the formula (3) is a quinophthalone type dye of the following formula (4) wherein $R^{11}$ is a hydrogen atom or a $C_1$–$C_4$ alkyl group, $R^{12}$ is a hydrogen atom or a halogen atom, and $R^{13}$ is a —$COOR^{14}$ group or a —$CONR^{15}R^{16}$ group, in which $R^{14}$ is a $C_3$–$C_{12}$ alkyl group which may be substituted or a phenyl group which may be substituted, and $R^{15}$ and $R^{16}$ are independently a lower alkyl group which may be substituted or an aryl group which may be substituted.

(4)

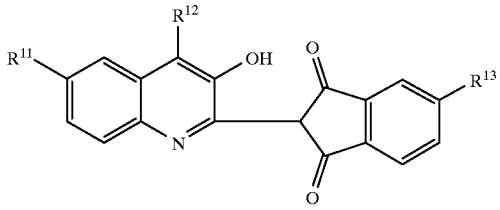

More preferably, in the above formula (4), $R^{11}$ is a hydrogen atom or $C_1$–$C_4$ alkyl group, $R^{12}$ is a hydrogen atom or a bromine atom, and $R^{13}$ is a —$COOR^{14}$ group or a —$CONR^{15}R^{16}$ group, in which $R^{14}$ is a $C_3$–$C_8$ alkyl group or a $C_3$–$C_8$ alkoxyalkyl group, and $R^{15}$ and $R^{16}$ are independently a lower alkyl group.

A quinophthalone type dye is poor in solubility because it contains a plurality of a hydroxyl group, a carbonyl bond and an aromatic ring in its molecule. For example, in the formula (4), when $R^{13}$ is a hydrogen atom, $R^{14}$ is a hydrogen atom and $R^{15}$ and $R^{16}$ are also hydrogen atoms at the same time, it tends to be poor in solubility.

When the above substituents are evaluated from the point of solubility, it is preferable that $R^{11}$ is an alkyl group, $R^{12}$ is a bromine atom, and $R^{13}$ is preferably a —$CONR^{15}R^{16}$ group rather than a —$COOR^{14}$ group, in which $R^{14}$ of the —$COOR^{14}$ group is preferably an alkyl group having a carbon number of at least 4 or an alkoxyalkyl group having a total carbon number of at least 6, and a larger carbon number is more preferable, and $R^{15}$ and $R^{16}$ of the —$CONR^{15}R^{16}$ are preferably an alkyl group having a carbon number of at least 2, and a larger carbon number is more preferable. When $R^{11}$ is an alkyl group, it works favorable in respect of solubility, but is unfavorable in respect to a cost since it requires a complicated synthesis route of many steps as compared with the case where $R^{11}$ is hydrogen.

A preferable combination example of a pyrazolonemethine type dye and a quinophthalone type dye includes a pyrazolonemethine type dye of the formula (1) wherein $R^1$ and $R^2$ are independently a lower alkyl group, a phenyl group which may be substituted with a methyl group or a halogen atom, or a benzyl group, and $R^3$ and $R^4$ are independently a lower alkyl group or a —$COOR^5$ group in which $R^5$ is a lower alkyl group, a phenyl group which may be substituted with a methyl group or a halogen atom, or a a benzyl group, and a quinophthalone type dye of the formula (4) wherein $R^{11}$ is a hydrogen atom or a $C_1$–$C_4$ alkyl group, $R^{12}$ is a hydrogen atom or a halogen atom, and $R^{13}$ is a —$COOR^{14}$ group or a —$CONR^{15}R^{16}$ group, in which $R^{14}$ is a $C_3$–$C_{12}$ alkyl group which may be substituted or a phenyl group which may be substituted, and $R^{15}$ and $R^{16}$ are independently a lower alkyl group which may be substituted or an aryl group which may be substituted.

The most preferable combination is a pyrazolonemethine type dye of the formula (1) wherein $R^1$ and $R^2$ are a methyl group, an ethyl group, a propyl group, a butyl group, a phenyl group or a tolyl group, and $R^3$ and $R^4$ are independently a methyl group or a —$COOR^5$ group in which $R^5$ is an ethyl group, a propyl group or a butyl group, and a quinophthalone type dye of the formula (4) wherein $R^{11}$ is a hydrogen atom or a $C_1$–$C_4$ alkyl group, $R^{12}$ is a hydrogen atom or a bromine atom, $R^{13}$ is a —$COOR^{14}$ group or a —$CONR^{15}R^{16}$ group, in which $R^{14}$ is a $C_3$–$C_8$ alkyl group or a $C_3$–$C_8$ alkoxyethyl group, and $R^{15}$ and $R^{16}$ are independently a $C_2$–$C_8$ alkyl group.

It is known from JP-A-60-53565 and JP-A-63-182193 that a quinophthalone type dye of the formula (3) of the present invention is usable for thermal dye transfer recording system.

An ordinary color print is expressed by the three primary colors of yellow, magenta and cyan, and a thermal dye transfer sheet used for thermal dye transfer recording system usually has three dye layers of yellow, magenta and cyan disposed in order on a substrate. In some cases, four dye layers including a black dye layer in addition to yellow, magenta and cyan dye layers, are disposed on a substrate.

When the above yellow dye layer of the present invention is used for full color image formation, preferable examples of a magenta dye used for a magenta dye layer favorably used in combination with the above yellow dye layer, include C.I. Disperse Red 60, C.I. Disperse Violet 26, C.I. Solvent Red 27, C.I. Solvent Red 19, an anthraquinone type dye, an imidazoleazo dye, a thiadiazoleazo type dye and the like.

Preferable examples of a cyan dye used for a cyan dye layer favorably used in combination with the above yellow dye layer, include an indoaniline type cyan dye. The indoaniline type cyan dye is preferable because of a high sensitivity and a high weather resistance, but it has a disadvantage that it is weak to catalytic fading phenomenon.

The catalytic fading phenomenon is a phenomenon of light-fading caused depending on a combination of dyes, and it is particularly remarkable in the combination of a cyan dye and a yellow dye. More particularly, it has been known that this phenomenon is liable to be caused when using an indoaniline type dye useful as a cyan dye. Depending on a yellow dye used to be combined, regardless of its light-resistance, a yellow dye remarkably fades an indoaniline type dye color used in combination therewith when they are exposed to light. Thus, among conventional yellow dyes usually used for thermal dye transfer recording, there has been no yellow dye which gives a high density and does not cause catalytic fading phenomenon when used in combination with an indoaniline type dye. It was therefore very difficult to provide a mixed color, i.e. green color (yellow color+cyan color) or black color (yellow+magenta+cyan), which has an excellent high-light resistance and gives a high density recording.

As a result of the study, the present inventors have found that a pyrazolonemethine type yellow dye not only provides a high optical density recording but also does not cause a catalytic fading phenomenon of an indoaniline type cyan used in combination therewith. Thus, it has been made possible by the present invention that a combination use of an indoaniline type cyan dye and a pyrazolonemethine type dye provides an image having a high optical density and a high light-resistance.

Accordingly, in the present invention, any of indoaniline type dyes can be used and a plurality of dyes can be blended as far as they satisfy the aimed object of the present invention.

Preferable examples of an indoaniline type dye include a dye of the following formula (5):

(5)

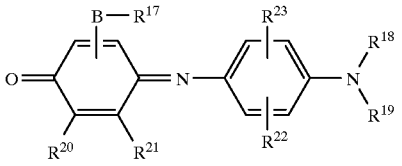

wherein —B— is —CONH—, —NHCO—, —NHCOO— or —$NHSO_2$—, $R^{17}$ is a lower alkyl group which may be substituted, a lower alkenyl group which may be substituted, an aryl group which may be substituted, an aralkyl group which may be substituted or a heterocyclic ring which may be substituted with an alkyl group or a halogen atom, $R^{18}$ and $R^{19}$ are independently a lower alkyl group which may be substituted, $R^{20}$ is a hydrogen atom or a halogen atom, $R^{21}$ is a hydrogen atom or an alkyl group which may be substituted or an acylamino group, $R^{22}$ is a hydrogen atom, a methyl group, an acylamino group, an alkoxycarbonylamino group or an alkylsulfonylamino group, $R^{23}$ is a hydrogen atom or a methyl group, and $R^{20}$ and $R^{21}$ may be connected to form a 6-membered aromatic ring which may contain a hetero atom.

More preferably, an indoaniline type dye of the above formula (5) is a dye of the following formula (6):

(6)

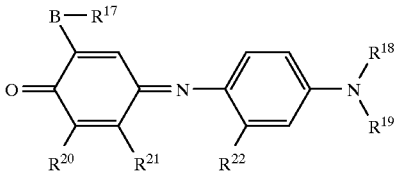

wherein —B— is —NHCO— or —NHCOO—, $R^{17}$ is a lower alkyl group which may be substituted, a lower alkenyl group which may be substituted, an aryl group which may be substituted, an aralkyl group which may be substituted or a heterocyclic ring which may be substituted with an alkyl group or a halogen atom, $R^{18}$ and $R^{19}$ are independently a lower alkyl group which may be substituted, $R^{20}$ is a hydrogen atom or a halogen atom, $R^{21}$ is a methyl group or an ethyl group, and $R^{22}$ is a hydrogen atom or a methyl group.

In the above definition of substituents of the formula (5) and (6), the term "lower" means "$C_1$–$C_8$", and an aryl group and aralkyl group usually have a carbon number of from 6 to 10.

Preferably, $R^{17}$ is an alkyl group, a lower alkenyl group, an aralkyl group, an aryl group, a halogeno-lower alkyl group, a hydroxy-lower alkyl group, a cyan-lower alkyl group, an ether bond-containing alkyl group, a heterocyclic ring-substituted alkyl group or a heterocyclic ring, $R^{18}$ is a lower alkyl group, $R^{19}$ is a lower alkyl group, a halogeno-lower alkyl group, a hydroxy-lower alkyl group, an amino-lower alkyl group, an ether bond containing alkyl group, an amino bond-containing alkyl group or a sulfonylamino bond-containing alkyl group, $R^{21}$ is a methyl group or an ethyl group, $R^{22}$ is a hydrogen atom or a methyl group, and $R^{20}$ is a hydrogen atom, a chlorine atom or a bromine atom.

More preferably, $R^{17}$ is a lower alkyl group, a lower alkenyl group, a $C_7$–$C_{10}$ aralkyl group, a $C_6$–$C_{10}$ aryl group, a chloroethyl group, a lower alkoxyalkyl group, a tetrahydrofurfuryl group, a $C_9$–$C_{12}$ aralkyloxyethyl group, a $C_8$–$C_{12}$ aryloxyethyl group, a lower alkenyloxyethyl group or a heterocyclic ring having O, N or S as a hetero atom, $R^{18}$ is a methyl group or an ethyl group, $R^{19}$ is a lower alkyl group, a chloroethyl group, a hydroxyethyl group, a lower alkoxyethyl group, a $C_9$–$C_{12}$ aralkyloxyethyl group or a $C_8$–$C_{12}$ aryloxyethyl group, $R^{21}$ is a methyl group or an ethyl group, $R^{22}$ is a hydrogen atom or a methyl group, and $R^{20}$ is a hydrogen atom or a chlorine atom.

Still more preferably, $R^{17}$ is a lower alkyl group, a lower alkenyl group, a phenyl group, a tolyl group, a benzyl group, a tetrahydrofurfuryl group, a lower alkoxy lower alkyl group, furan, pyridine or thiophene, $R^{18}$ and $R^{19}$ are ethyl groups, $R^{21}$ is a methyl group or an ethyl group, $R^{22}$ is a hydrogen atom or a methyl group, and $R^{20}$ is a hydrogen atom or a chlorine atom.

When $R^{20}$ is a chlorine atom, $R^{17}$ preferably has at least 2 carbon atoms since it improves the solubility of a dye.

Preferable combination examples of a pyrazolonemethine type dye and an indoaniline type dye to be used in a mixture, include a pyrazolonemethine type dye of the formula (1) wherein $R^1$ and $R^2$ are independently a lower alkyl group, an aryl group which may be substituted or an aralkyl group, and $R^3$ and $R^4$ are a lower alkyl group or a —$COOR^5$ group in which $R^5$ is a lower alkyl group, an aryl group which may be substituted or an aralkyl group, and an indoaniline type dye of the formula (6) wherein —B— is —NHCO— or —NHCOO—, $R^{17}$ is a lower alkyl group, a lower alkenyl group, a $C_7$–$C_{10}$ aralkyl group, a $C_6$–$C_{10}$ aryl group, a chloroethyl group, a lower alkoxy lower alkyl group, a tetrahydrofurfuryl group, a $C_9$–$C_{12}$ aralkyloxyethyl group, a $C_8$–$C_{12}$ aryloxyethyl group, a lower alkenyloxyethyl group, a tetrahydrofurfuryloxyethyl group or a heterocyclic ring containing O, N or S as a hetero atom, $R^{18}$ and $R^{19}$ are a methyl group or an ethyl group, $R^{20}$ is a hydrogen atom or a chlorine atom, $R^{21}$ is a methyl group or an ethyl group, and $R^{22}$ is a hydrogen atom or a methyl group.

More preferable combination examples include a pyrazolonemethine type dye of the formula (1) wherein $R^1$ and $R^2$ are independently a methyl group, an ethyl group, a propyl group, a butyl group, a phenyl group or a tolyl group, and $R^3$ and $R^4$ are independently a methyl group or a —$COOR^5$ group in which $R^5$ is an ethyl group, a propyl group or a butyl group, and an indoaniline type dye of the formula (6) wherein —B— is —NHCO—, $R^{17}$ is a lower alkyl group, a lower alkenyl group, a phenyl group, a tolyl group, a benzyl group, a tetrahydrofurfuryl group, a lower alkoxy lower alkyl group, furan, pyridine or thiophene, $R^{18}$ and $R^{19}$ are ethyl groups, $R^{20}$ is a hydrogen atom or a chlorine atom, $R^{21}$ is a methyl group or an ethyl group, and $R^{22}$ is a hydrogen atom or a methyl group.

It is known from JP-A-61-31292 and JP-A-61-35994 that a part of the indoaniline type dye of the formula (6) of the present invention is usable for thermal dye transfer recording system.

The main component contained in a dye layer other than a dye is a binder resin. Preferable examples of the binder resin include a cellulose type resin such as ethylcellulose, hydroxyethylcellulose, ethylhydroxycellulose, hydroxypropylcellulose, methylcellulose, cellulose acetate or the like, a butyral resin, an acetal resin, a phenoxy resin, a polycarbonate resin, a vinyl chloride-vinyl acetate resin, an acrylonitrile-styrene resin, a polyester resin, and the like.

A preferable ratio of a dye and a binder in a dye layer is dye/resin=from 10/100 to 300/100. If the dye/resin ratio is lower than 10/100, an amount of a dye is too small to provide a satisfactory coloring sensitivity and a satisfactory thermal dye transfer image can not be obtained. On the contrary, if the dye/resin ratio exceeds 300/100, a dye becomes too poor in solubility to a binder resin, and therefore a dye layer of a thermal dye transfer sheet obtained therefrom becomes too poor in shelf stability (that is, a dye is liable to precipitate).

In order to avoid the above-mentioned problems, a more preferable dye/resin ratio in the present invention is dye/resin=from 40/100 to 200/100, most preferably from 66/100 to 150/100.

When taking these points into consideration, it is preferable to use a binder resin having a higher compatibility with a dye and causing no problem when containing a dye at a high concentration. Thus, among the above-mentioned binder resins, it is preferable to use a resin having a Tg value of at least 50° C., such as a phenoxy resin, a polyvinyl butyral resin, a vinyl chloride-vinyl acetate resin and an acryl-styrene resin. Particularly, a phenoxy resin and a polyvinyl butyral resin are preferable since they can contain a dye at a high concentration.

The dye layer of the thermal dye transfer sheet of the present invention are made basically from the above-mentioned materials, but it is preferable for avoiding a fusing between the thermal dye transfer sheet and an image-receiving material to incorporate a release agent into the dye layer by taking compatibility of the thermal dye transfer sheet with the image-receiving material into consideration, if necessary.

Preferable examples of the release agent include a silicone oil, a silicone resin and the like, and it is more preferable to employ a silicone-modified resin having the main chain modified with silicone for imparting a higher shelf stability to the thermal dye transfer sheet.

Examples of the main chain used for such a release agent include an acrylic type resin, a cellulose type resin, a vinyl type resin or a polyester type resin, but particularly preferable examples include an acrylic type resin or a polyester type resin. When a film is formed from an ink for a dye layer containing such a release agent, the silicone part is bleeded on the surface (due to low compatibility to the dye layer ink), thereby achieving a satisfactory release property during heating.

The release agent is incorporated preferably in an amount of from 0.01% to 10% to the solid content of the dye layer ink. If the amount of the release agent is lower than 0.01%, a satisfactory release property can not be achieved. On the other hand, if the amount of the release agent exceeds 10%, it becomes difficult to form a satisfactory dye layer on a substrate sheet or the bleeded amount of silicone on the surface of the dye layer becomes so large that an image-receiving layer tends to be easily polluted.

The dye layer is formed by preparing a dye layer ink having the above-mentioned dye, a binder resin and other additives dissolved or dispersed in an appropriate solvent, coating the dye layer ink on the above-mentioned substrate sheet and drying.

Examples of a solvent used for the ink include aromatic type solvents such as toluene and xylene; ketone type solvents such as methyl ethyl ketone, methyl isobutyl ketone and cyclohexanone; ester type solvents such as ethyl acetate and butyl acetate; alcohol type solvents such as isopropanol, butanol and methyl cellosolve, ether type solvents such as dioxane and heterohydrofuran; and amide type solvents such as dimethylformamide and N-methylpyrrolidone. In addition to the above-mentioned components, the ink may further contain organic or inorganic non-sublimable particles, a dispersing agent, an antistatic agent, an anti-blocking agent, a defoaming agent, an antioxidant, a viscosity regulator and other additives, if necessary. Further, an infrared ray-absorbing agent or carbon black may be added to be used for sublimable dye transfer system using a laser light. A means for providing a dye layer by coating the above-mentioned ink is not specially limited, but a gravier printing machine, a reverse roll coater or the like may be used. A coating film thickness is appropriately from 0.1 to 5 $\mu$m, preferably from 0.4 to 3 $\mu$m, more preferably from 0.5 to 2 $\mu$m on the basis of a dry film thickness. A coating amount is from 0.3 to 1.5 $g/m^2$.

If the thickness of the dye layer is smaller than 0.2 $\mu$m, a satisfactory coloring density can not be achieved. On the other hand, if the thickness exceeds 5 $\mu$m, a coloring sensitivity becomes poor.

As mentioned above, in order to improve the heat-resistance and lubricating property of a thermal dye transfer sheet, it is sometimes preferable to provide a heat-resistant layer on the opposite side of a dye layer of a substrate sheet.

The heat-resistant layer is not specially limited, but it is known to use a cured resin of a UV ray-cured resin or a thermoplastic resin having a high Tg value. Since the heat-resistant layer requires not only a heat-resistance to the heat of a thermal head but also a lubricating property to the thermal head, it is general for the heat-resistant layer to contain such a lubricating agent as a silicone oil.

Generally, in order to carry out thermal dye transfer recording, a dye layer of a thermal dye transfer sheet is brought into contact with an image-receiving layer of an image-receiving sheet provided on one side of a substrate, and heat is applied depending on an image signal by using a heat source such as a line type thermal head on the opposite side of a dye layer of the thermal transfer sheet, thereby transferring a dye in the dye layer to the image-receiving layer. In accordance with the heat amount applied, a dye amount to be transferred can be controlled, thereby achieving light and shade expressions and obtaining precise images. With regard to three colors of yellow, magenta and cyan or four colors additionally including black, the same operation as mentioned above is repeated, thereby obtaining a photograph-tone image.

As a thermal dye transfer sheet for obtaining a color image, there is a system of employing a plurality of respectively separate thermal dye transfer sheets of each color or a system of employing a thermal dye transfer sheet having a plurality of dye layers provided on the same single sheet. Either system may be employed, but the single thermal dye transfer sheet having a plurality of dye layers provided on the same sheet is preferable since a color image can be formed by only one thermal dye transfer sheet and a device for carrying out the thermal dye transfer recording is simple.

As a heat source for carrying out the transferring of a dye, there are generally known a line type thermal head and a laser light. In the case of using a laser light, a light-heat conversion material is required to transfer the laser light into heat, and an infrared ray-absorbing agent and carbon black may be incorporated in a dye layer of a thermal dye transfer sheet, between the dye layer and a substrate or the opposite side of the dye layer.

An image-receiving sheet used for forming an image by means of the above-mentioned thermal dye transfer sheet, may be any type of image-receiving sheet as far as its recording phase has an image-receiving property to the above-mentioned dye. Thus, any type of image-receiving sheet may be used as far as its recording phase is an image-receiving material. An image-receiving layer is generally provided on at least one side of a substrate. Examples of the substrate include a synthetic paper, a cellulose paper, a cast coat paper, and a substrate having synthetic papers attached to both sides of a film or cellulose paper. The surface of the substrate is preferably smooth so that a satisfactory intimate contact with a dye layer can be made at the time of recording, thereby achieving a satisfactory uniform transferring of a dye. Thus, if possible, it is preferable to use a substrate having a beck smoothness of at least 10,000 seconds. From this point of view, it is preferable to use a synthetic paper or film as a substrate.

An image-receiving layer is a layer comprising a resin as the main component, and has a function of forming an image by receiving a dye. Thus, it is preferable to use a resin easily dyeable with a dye, examples of which include polyolefin type resins such as polyethylene or polypropylene, acetal resin, polyvinyl chloride resin, vinyl chloride-vinyl acetate copolymer resin, polyester resin, polystyrene resin, a copolymer resin of an olefin and other vinyl monomer, ionomer, cellulose type resin, polycarbonate resin, and the like. These resins may be used in combination. It is not preferable to use a resin, the glass transition point of each is too low, since an image blurs during storing. Thus, it is preferable to use an image-receiving layer having a glass transition temperature of at least 35° C. as an image-receiving layer.

If necessary, an image-receiving layer may further contain additives in addition to a resin. Examples of the additives include a curing agent such as isocyanate for curing a resin, a release agent such as silicone to be added for preventing a fusing between the image-receiving layer and a dye layer during thermal dye transferring, a UV ray-absorbing agent to improve light-resistance, an antioxidant to improve weather-resistance, and the like, but the additives to be added are not limited thereto.

With regard to a thickness of an image-receiving layer, if the thickness is too small, a satisfactory coloring density can not be obtained.

When the recording surface does not have an image-receiving property (such as paper, metal, glass, a resin having no dye-receiving property, and the like), an image-receiving layer (comprising a dye-receiving material) is provided on the recording surface having no dye-receiving property, thereby forming a dye-receiving layer, and an image from a thermal dye transfer sheet may be formed thereon. Alternatively, an image from a thermal dye transfer sheet is formed on a separate image-receiving layer, and the image-receiving layer having the image thus formed may be attached to a recording surface having no dye-receiving property.

EXAMPLES

Now, the present invention will be described in further detail with reference to Examples. However, it should be understood that the present invention is by no means restricted to such specific Examples. In the present specification, "part" means part by weight and "%" means % by weight.

Example 1

A thermal dye transfer sheet of the present invention was obtained by preparing an ink composition of the following composition for a dye layer and coating and drying the ink composition in a polyethyleneterephthalate film of a thickness of 5.4 μm provided with a heat-resistant layer on its backside in such a manner as to provide a dry coating thickness of 1.5 μm.

(Ink for dye layer)

C.I Solvent Yellow 93 4.0 parts

Butyral resin 5.0 parts

Methyl ethyl ketone 60.0 parts

Toluene 31.0 parts

The above C.I. Solvent Yellow 93 is a pyrazolonemethine type dye of the formula (1) wherein $R^1$ and $R^2$ are a phenyl group and $R^3$ and $R^4$ are a methyl group.

Thereafter, an image-receiving sheet was prepared by coating an ink of the following composition for an image-receiving layer on one side of a layered structure sheet of foamed polypropylene film (thickness 50 μm)/adhesive resin layer/coated paper (108 g/m$^2$)/adhesive resin layer/foamed polypropylene film (thickness 50 μm) as a substrate sheet so as to provide a dry coating thickness of 4 μm, drying the coated film and then subjecting the coated film to aging at 45° C. for one week.

(Ink for image-receiving layer)

Acetal resin 10.0 parts

Vinyl chloride-vinyl acetate copolymer resin 10.0 parts

Silicone oil 2.0 parts

Isocyanate resin 3.0 parts

Methyl ethyl ketone 50.0 parts

Toluene 25.0 parts

The dye layer side of the above-obtained thermal dye transfer sheet was brought into contact with the dye-receiving layer of the above prepared image-receiving sheet, and the dye was transferred by using a thermal head under the following conditions to form an image.

(Printing conditions)

Printer: Simulator manufactured by SIP Co. (300 dots/mm Head)

Printing pattern: 16 tone pattern

Printing energy: 0.6 mJ/dot at 16th tone

The image thus formed was evaluated in the following manner.

(Evaluation items)

Coloring density: a reflective density at the 16th tone was measured by Macbeth RD-918.

Heat tranfer-resistance: density reduction rate at the 16th tone after 8 hours at 70° C.

Light-resistance: density reduction rate at the 16th tone after irradiating with a xenon fade meter for 80 hours.

Evaluation results with regard to the above items were satisfactory as shown below. Also, a color reproducibility of yellow color was satisfactory.

Under the above printing conditions, the following coloring density could be obtained, and its coloring sensitivity was also satisfactory.

(Evaluation results)

Coloring density: 2.4

Heat transfer-resistance: at most 5%

Light-resistance: at most 3%

Example 2

A thermal dye transfer sheet was obtained in the same manner as in Example 1, except that an ink composition of the following composition for a dye layer was used.

(Ink for dye layer)

C.I. Solvent Yellow 93 3.0 parts

C.I. Solvent Yellow 16 1.0 parts

Butyral resin 5.0 parts

Methyl ethyl ketone 60.0 parts

Toluene 31.0 parts

The above C.I. Solvent Yellow 16 is a pyrazoloneazo type dye of the formula (2), wherein A is a phenyl group, $R^8$ is a phenyl group, and $R^9$ is a methyl group.

The obtained thermal dye transfer sheet was placed on an image-receiving sheet obtained in the same manner as in Example 1, and an image was formed and evaluated in the same manner as in Example 1. The evaluation results are shown below.

Under the above printing conditions, the following coloring density could be obtained, and its coloring sensitivity was also satisfactory.

(Evaluation results)

Coloring density: 2.4

Heat tranfer-resistance: at most 5%

Light-resistance: at most 3%

Also, a color reproducibility of yellow color was evaluated to be satisfactory.

Example 3

A thermal dye transfer sheet was obtained in the same manner as in Example 1, except that an ink composition of the following composition for a dye layer was used.

(Ink for dye layer)

C.I. Solvent Yellow 93 3.0 parts

C.I. Solvent Yellow 16 1.0 parts

Phenoxy resin 3.0 parts

Butyral resin 2.0 parts

Methyl ethyl ketone 60.0 parts

Toluene 31.0 parts

The obtained thermal dye transfer sheet was placed on an image-receiving sheet obtained in the same manner as in Example 1, and an image was formed and evaluated in the same manner as in Example 1. The evaluation results are shown below.

Under the above printing conditions, the following coloring density could be obtained, and its coloring sensitivity was also satisfactory.

(Evaluation results)

Coloring density: 2.3

Heat tranfer-resistance: at most 5%

Light-resistance: at most 3%

Also, a color reproducibility of yellow color was evaluated to be satisfactory.

Example 4

A thermal dye transfer sheet was obtained in the same manner as in Example 1, except that an ink composition of the following composition for a dye layer was used.

(Ink for dye layer)

C.I. Solvent Yellow 93 3.0 parts

C.I. Solvent Yellow 16 1.0 parts

Phenoxy resin 5.0 parts

Silicone-modified resin 0.05 part

Methyl ethyl ketone 60.0 parts

Toluene 31.0 parts

The obtained thermal dye transfer sheet was placed on an image-receiving sheet obtained in the same manner as in Example 1, and an image was formed and evaluated in the same manner as in Example 1. The evaluation results are shown below.

Under the above printing conditions, the following coloring density could be obtained, and its coloring sensitivity was also satisfactory.

(Evaluation results)

Coloring density: 2.4

Heat tranfer-resistance: at most 5%

Light-resistance: at most 3%

Also, a color reproducibility of yellow color was evaluated to be satisfactory.

Example 5

A thermal dye transfer sheet was obtained in the same manner as in Example 1, except that Dye 1-2 (compound of the formula (1) wherein $R^1$ and $R^2$ are an o-tolyl group and $R^3$ and $R^4$ are a methyl group) was used in placed of C.I. Solvent Yellow 93. An image was formed by using the above obtained thermal dye transfer sheet and was evaluated in the same manner as in Example 1. The evaluation results are shown below.

Under the above printing conditions, the following coloring density could be obtained, and its coloring sensitivity was also satisfactory.

(Evaluation results)

Coloring density: 2.4

Heat tranfer-resistance: at most 5%

Light-resistance: at most 3%

Also, a color reproducibility of yellow color was evaluated to be satisfactory.

Example 6

A thermal dye transfer sheet was obtained in the same manner as in Example 1, except that Dye 1-3 (compound of the formula (1) wherein $R^1$ is a phenyl group, $R^2$ is an o-tolyl group, and $R^3$ and $R^4$ are a methyl group) was used in placed of C.I. Solvent Yellow 93. An image was formed by using the above obtained thermal dye transfer sheet and was evaluated in the same manner as in Example 1. The evaluation results are shown below.

Under the above printing conditions, the following coloring density could be obtained, and its coloring sensitivity was also satisfactory.

(Evaluation results)

Coloring density: 2.4

Heat tranfer-resistance: at most 5%

Light-resistance: at most 3%

Also, a color reproducibility of yellow color was evaluated to be satisfactory.

Example 7

A thermal dye transfer sheet was obtained in the same manner as in Example 2, except that Dye 2-2 (compound of the formula (2) wherein A is a m-chlorophenyl group, and $R^8$ is a m-tolyl group, and $R^9$ is a methyl group) was used in placed of C.I. Solvent Yellow 16. An image was formed by using the above prepared thermal dye transfer sheet and was evaluated in the same manner as in Example 2. The evaluation results are shown below.

Under the above printing conditions, the following coloring density could be obtained, and its coloring sensitivity was also satisfactory.

(Evaluation results)

Coloring density: 2.4

Heat tranfer-resistance: at most 5%

Light-resistance: at most 3%

Also, a color reproducibility of yellow color was evaluated to be satisfactory.

Effects of Examples 1 to 7

As mentioned above, according to the present invention, by using a pyrazolonemethine type dye of the formula (1) or a combination of a pyrazolonemethine type dye of the formula (1) and a pyrazoloneazo type of the formula (2) in the same dye layer for a thermal sublimable dye transfer recording system employing a thermal head or a laser as a heat source, it is possible to provide an image having a faithful color reproducibility of an original image and a satisfactory fastness (heat transfer-resistance and dye-resistance), and also possible to provide a satisfactory coloring property (high coloring sensitivity) and a satisfactory coloring density by a small heat energy.

Further, by incorporating a silicone type release agent into the dye layer, it is possible to prevent fusing of a dye-receiving layer during thermal dye transfer recording, and also possible to largely wide a range of a choice of a satisfactory material to be used in the dye-receiving layer. Thus, the incorporation of a silicone type release agent achieves excellent performances in these respects.

Generally, according to the present invention, a thermal dye transfer sheet achieving the above-mentioned excellent performances can be provided particularly with regard to thermal dye transfer recording system of yellow color.

Example 8

(a) Preparation of thermal dye transfer sheet

An ink obtained by mixing and stirring 50 parts of Dye 1-1 (Solvent Yellow 93, i.e. a dye of the formula (1) wherein $R^1$ and $R^2$ are a phenyl group and $R^3$ and $R^4$ are a methyl group), 50 parts of Dye 3-1 (a dye of the formula (4) wherein $R^{11}$ is a hydrogen atom, $R^{12}$ is a bromine atom, and $R^{13}$ is $CONR^{15}R^{16}$, in which $R^{15}$ and $R^{16}$ are a propyl group), 100 parts of phenoxy resin (tradename: PKHH manufactured by Union Carbide Co.), 125 parts of methyl ethyl ketone, 450 parts of toluene and 300 parts of tetrahydrofuran (THF), was coated and dried on a polyester film of 6 μm by a bar coater so as to provide a dry film thickness of 1 μm.

On the back side of the above obtained polyester film, was coated a mixture solution of 10 parts by weight of acrylic resin (tradename: BR-80 manufactured by Mitsubishi Rayon K.K.), 1 part by weight of amino-modified silicone oil (tradename: KF 393 manufactured by Shin-Etsu Kagaku K.K.) and 89 parts by weight of toluene by a bar coater to provide a dry film thickness of 1 μm and dried to provide a heat-resistant layer.

(b) Preparation of image-receiving layer

A solution obtained by mixing and stirring 46 parts of polyvinylphenylacetal resin, 20 parts of vinyl chloride/vinyl acetate/vinyl alcohol copolymer resin (tradename: VAGD manufactured by Union Carbide Co.), 30 parts of silicone varnish (tradename: KR 311 (non-volatile content 60%) manufactured by Toshiba Silicone K.K.), 6 parts of polyoxyethylenealkylphenyl ether (tradename: OP-10 manufactured by Nikko Chemicals K.K.), 1 part of amino-modified silicone oil (tradename: KF 393 manufactured by Shin-Etsu Kagaku Kogyo K.K.), 12 parts of hexamethylenediisocyanate type polyfunctional isocyanate compound (tradename: Mytec NY-710A (solid content concentration 75%) manufactured by Mitsubishi Chemical Co.), 200 parts of methyl ethyl ketone and 200 parts of toluene, was coated on a polypropylene-made synthetic paper of a thickness of 150 μm (tradename: Yupo FPG 150 manufactured by Oji Yuka Goseishi K.K.) by a wire bar and dried (dry film thickness about 5 μm), and was further heat-treated in an oven at 80° C. for 12 hours to obtain an image-receiving sheet.

The above polyvinylphenylacetal resin is obtained by acetalizing polyvinyl alcohol (saponification value: 99 mol %, polymerization degree: 1,700) with phenylacetaldehyde, and has the following structure formula (7)

(7)

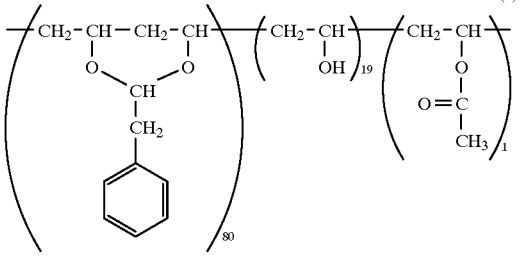

(c) Print recording

The dye layer of the thermal dye transfer sheet obtained in the above paragraph (a) was brought into contact with the resin coating surface of the image-receiving sheet obtained in the above paragraph (b), printing was carried out by using a partly glace type line thermal head having a density of 5.6 dots/mm under conditions of a conveying speed of 6 lines (dots)/mm in the conveying direction, a printing speed of 16.6 ms/line and an applied electric power of 0.20 W/dot. The time applied to the head per line was made 12 ms, thereby providing a deep color printing.

(d) Measurement of density

The density of the printed matter printed as mentioned in the above paragraph (c) was measured by a refractive densitometer (tradename; Macbeth RD-920 containing a filter having a SPI spectral sensitivity manufactured by Macbeth Co.). As this result, a density was 1.9.

(e) Light-resistance test 1

A deep color sample of the printed matter printed as described in the above paragraph (c) was subjected to a light-resistance test for 72 hours at an illuminance of 3.5 $kg/m^2$ by using a xenon lamp light-resistance tester (tradename: Atlas Ci35A weatherometer manufactured by Toyo Seiki Seisakusho K.K.). A chrominance of the printed matter was measured before and after the light-resistance test by using a chrominance-meter having an optical system in accordance with JIS Z-8722 (tradename: Spectral Chrominance-meter SZ-Σ80 manufactured by Nihon Denshoku Kogyo K.K.) under conditions of a C-light source and a visual field angle of 2°. As this result, the color difference in the CIELAB color system (ΔEab*) was small and its value was 6.0.

(f) Light-resistance test 2

A thermal dye transfer sheet was prepared in the same manner as described in the above paragraph (a), except that 60 parts of an indophenol type dye of the following structural formula was used. By using the thermal dye transfer sheet thus prepared, a cyan color printed matter was obtained by conducting thermal dye transfer recording on the image-receiving sheet obtained in the above paragraph (b) under the same printing conditions as described in the above paragraph (c). On the cyan color printed matter, thermal dye transfer recording was conducted by using the thermal dye transfer sheet obtained in the above paragraph (a) under the same printing conditions as described in the above paragraph (c) to obtain a green color printed matter. The green color printed matter thus obtained was subjected to a light-resistance test under the same conditions as described in the above paragraph (e), and a chrominance was measured before and after the light-resistance test by using the same chrominance-meter under the same color difference in conditions as mentioned above. As this result, the color difference in CIELAB color system was small and its measured value was 12.0. Also, a printed matter printed by cyan color only was subjected to the same light-resistance test under the same conditions, and at this result, the color differences in CIELAB color system was small and its measured value (ΔEab*) was 8.0.

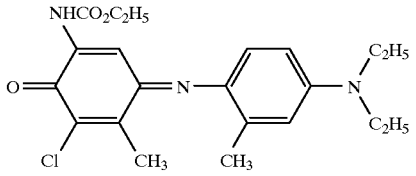

(g) Shelf stability test

The thermal dye transfer sheet obtained in the above paragraph (a) was stored for one week under conditions of 40° C. and a relative humidity of 80%, and was subjected to the printing test in the above paragraph (c). Thereafter, a density change of the printed matter before and after storing was measured, and was expressed by %. As this result, the density change was −5% and was proved to be very small.

Examples 9 to 14

The same procedure as in Example 8 was repeated, except that such combinations of dyes as shown in the following Table 1 were used, and their results are shown in the following Table 2. Any of these Examples shows a satisfactorily high density and a satisfactory light-resistance.

TABLE 1

| | Pyrazolonemethine type dye | Quinophthalone type dye |
|---|---|---|
| Example 8 | Dye No. 1-1 50 parts | Dye No. 3-1 50 parts |
| Example 9 | Dye No. 1-2 60 parts | Dye No. 3-2 40 parts |
| Example 10 | Dye No. 1-6 50 parts | Dye No. 3-3 40 parts |
| Example 11 | Dye No. 1-4 60 parts | Dye No. 3-4 30 parts |
| Example 12 | Dye No. 1-5 45 parts | Dye No. 3-5 45 parts |
| Example 13 | Dye No. 1-3 35 parts | Dye No. 3-6 20 parts |
| | | Dye No. 3-7 30 parts |
| Example 14 | Dye No. 1-7 40 parts | Dye No. 3-8 35 parts |
| | | Dye No. 3-9 35 parts |

Dyes 1-1 to 1-7 used in respective Examples are pyrazolonemethine type dyes having the following structural formulas, and Dyes 3-1 to 3-9 are quinophthalone type dyes having the following structural formulas.

Dye 1-1

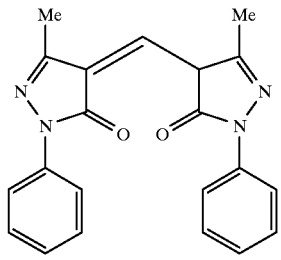

Dye 1-2

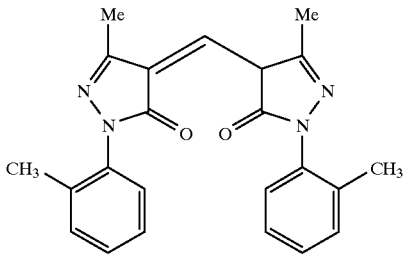

Dye 1-3

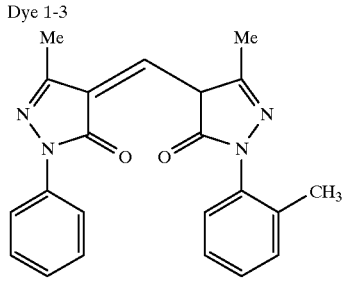

Dye 1-4

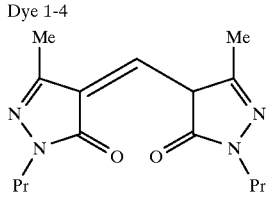

Dye 1-5

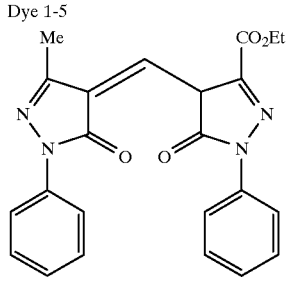

Dye 1-6

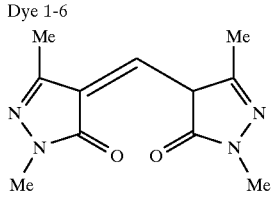

-continued

Dye 1-7

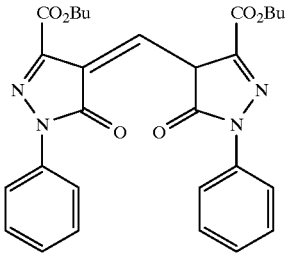

Dye 3-1

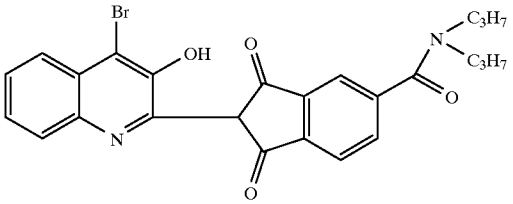

Dye 3-2

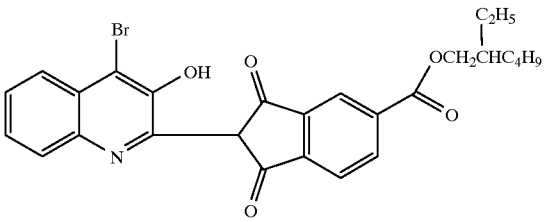

Dye 3-3

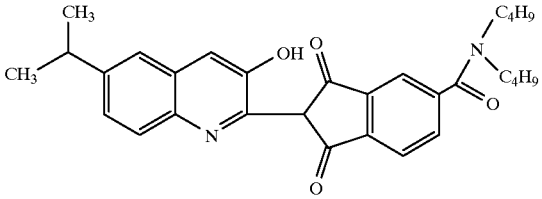

Dye 3-4

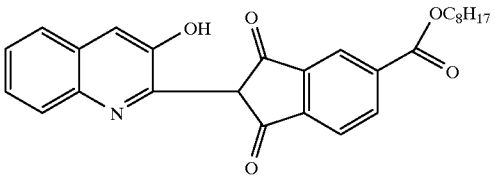

Dye 3-5

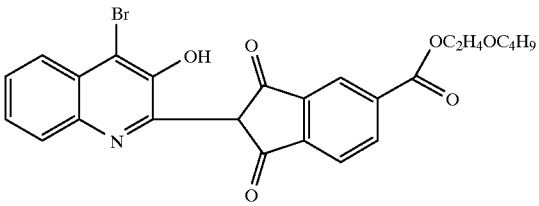

Dye 3-6

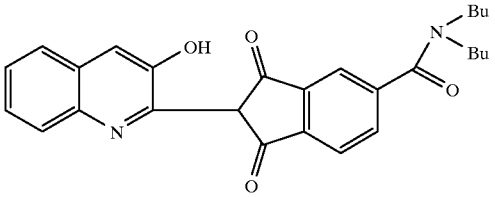

-continued

Dye 3-7

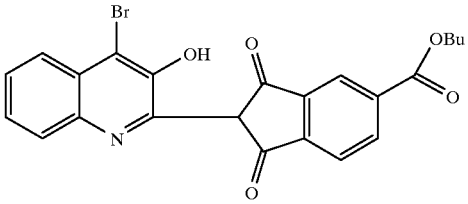

Dye 3-8

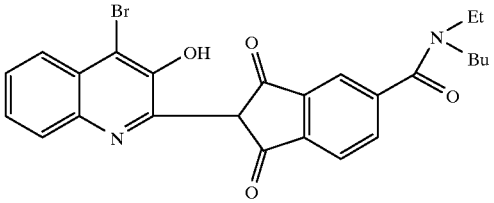

Dye 3-9

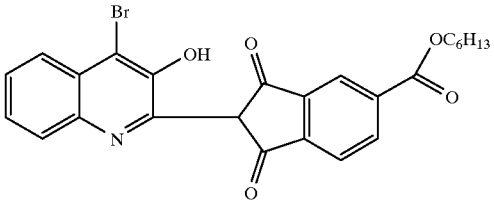

Examples 15 to 17

The same procedure as in Example 8 was repeated (light-resistance test was omitted), except that the phenoxy resin (tradename: PKHH manufactured by Union Carbide Co.) used as a binder resin in the dye layer of Example 8 was replaced by the following resins. The results are shown in the following Table 2.

Example 15: Polyvinylbutyral resin (tradename: BX-1 manufactured by Sekisui Kagaku K.K.)

Example 16: Vinylchloride-vinylacetate resin (tradename: VYHD manufactured by Union Carbide Co.)

Example 17: AS resin (tradename: SEBIAN-N020 manufactured by Disel Kagaku Kogyo K.K.)

Comparative Example 1

The same procedure as in Example 8 was repeated, except that 0 part of Dye 1-1 and 90 parts of Dye 3-1 were used. Since a coating solution for a dye layer becomes heterogeneous due to poor solubility of the dye, a solvent amount was 1.5 times increased for coating. The dried dye layer thus coated was opaque, and was proved to have many crystals of Dye 3-1 precipitated according to observation by a microscope. An optical density was low and its measured value was 1.4. From this result, it was proved to be difficult to improve a density by increasing the dye content of Dye 3-1 in the dye layer. With regard to a light-resistance, a measured color difference (ΔEab*) of monocolor was 5.0 and a color difference (ΔEab*) of mixed color (green) was 12.0, which proved satisfactory results. These results are shown in the following Table 2.

Comparative Example 2

The same procedure as in Example 8 was repeated, except that 0 part of Dye 1-1 and 50 parts of Dye 3-1 were used. The dried dye layer thus obtained was transparent. According to observation by a microscope, there was no crystal of Dye 3-1. An optical density was 1.2 and was low and unsatisfactory. The light-resistance result was satisfactory. Judging from Comparative Examples 1 and 2, it was proved to be difficult to maintain both a high density and a high shelf stability in the case of using a quinophthalone type dye alone. The results are shown in the following Table 2.

Comparative Example 3

The same procedure as in Example 8 was repeated, except that 100 parts of Dye 1-1 and 0 part of Dye 3-1 were used. An optical density was 1.9. With regard to the light-resistance, a chrominance value of monocolor was 7.0 and a chrominance value of mixed color (green) was 16.0, thus providing satisfactory results. The shelf stability was −20%, and was proved to be unsatisfactory. This is probably due to unsatisfactory solubility of Dye 1-1 since there were observed many crystals of Dye 1-1 in the dye layer by a microscope. The results are shown in the following Table 2.

Comparative Example 4

The same procedure as in Example 8 was repeated, except that 60 parts of Dye 1-1 and 0 part of Dye 3-1 were used. An optical density was 1.5. With regard to the light-resistance, a chrominance value of monocolor was 7.0 and a chrominance value of mixed color (green) was 16.0, thus providing satisfactory results. The shelf stability was −5%, and was proved to be satisfactory. Judging from Comparative Examples 3 and 4, it was proved to be difficult to maintain both a high density and a satisfactory shelf stability by using a pyrazolonemethine type dye alone. The results are shown in the following Table 2.

Comparative Example 5

The same procedure as in Example 8 was repeated, except that 50 parts of Dye 3-1 and 50 parts of pyridone type dye of the following structural formula were used. An optical density was 1.9, and was proved to be satisfactory. With regard to the light-resistance, a measured color difference (ΔEab*) of monocolor was 16.0 and a measured color difference (ΔEab*) of mixed color (green) was 30.0, thus providing unsatisfactory results. This is not only due to the unsatisfactory light-resistance of monocolor but also due to the degradation of the light-resistance of green color by catalytic fading phenomenon. The results are shown in the following Table 2.

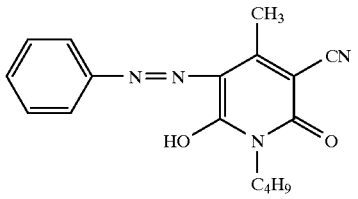

Comparative Example 6

The same procedure as in Example 8 was repeated, except that 50 parts of a quinophthalone type dye of the following structural formula which corresponds to a dye of the formula (4) wherein all of $R^{11}$, $R^{12}$ and $R^{13}$ are hydrogen atoms and 50 parts of the pyridone type dye used in Comparative Example 5, were used. An optical density was 1.5, and was proved to be unsatisfactory. With regard to the light-resistance, a measured color difference (ΔEab*) of monocolor was 16.0, and a measured color difference (ΔEab*) of mixed color (green) was 30.0, thus providing unsatisfactory results. This is not only due to the unsatisfactory light-resistance of monocolor but also due to the degradation of the light-resistance of green color by catalytic fading phenomenon. The shelf stability was −15%. The results are shown in the following Table 2.

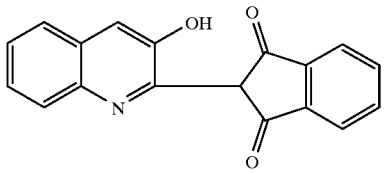

Comparative Example 7

The same procedure as in Example 8 was repeated, except that 50 parts of Dye 3-2 and 50 parts of a styryl type dye of the following structural formula were used. An optical density was 2.3, and was satisfactory. With regard to the light-resistance, a measured color difference (ΔEab*) of monocolor was 20.0, and a measured color difference (ΔEab*) of mixed color (green) was 45.0, thus providing unsatisfactory results. This is not only due to the unsatisfactory light-resistance of monocolor but also due to the degradation of the light-resistance of green color by catalytic fading phenomenon. The shelf stability was −5%. The results are shown in the following Table 2.

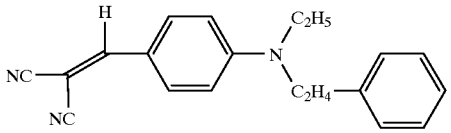

Comparative Example 8

The same procedure as in Example 8 was repeated, except that 50 parts of Dye 1-1 and 50 parts of a pyridone type dye used in Comparative Example 5 were used. An optical density was 1.5, and was proved to be unsatisfactory. With regard to the light-resistance, a measured color difference (ΔEab*) of monocolor was 12.0, and a measured color difference (ΔEab*) of mixed color (green) was 24.0, thus providing unsatisfactory results. This is not only due to the unsatisfactory light-resistance of monocolor but also due to the degradation of the light-resistance of green color by catalytic fading phenomenon. The shelf stability was −5%. The results are shown in the following Table 2.

Comparative Example9

The same procedure as in Example 8 was repeated, except that 50 parts of Dye 3-2 and 50 parts of a pyrazoloneazo type dye having the following structural formula were used. An optical density was 1.9, and was proved to be satisfactory. With regard to the light-resistance, a color difference (ΔEab*) of monocolor was 15.0, and a color difference (ΔEab*) of mixed color (green) was 30.0, thus providing unsatisfactory results. This is not only due to the unsatisfactory light-resistance of monocolor but also due to the degradation of the light-resistance of green color by catalytic fading phenomenon. The shelf stability was −5%. The results are shown in the following Table 2.

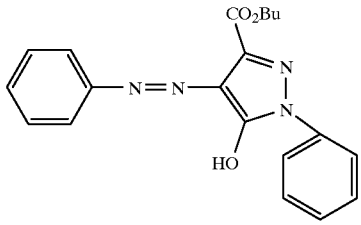

TABLE 2

| | Optical Density | Light-resistance (yellow) (ΔEab*) | Light-resistance (green) (ΔEab*) | Shelf stability |
|---|---|---|---|---|
| Example 8 | 1.9 | 6.0 | 13.0 | −5% |
| Example 9 | 1.9 | 6.5 | 14.0 | −5% |
| Example 10 | 1.7 | 6.0 | 13.0 | −5% |
| Example 11 | 1.7 | 7.0 | 15.0 | −10% |
| Example 12 | 1.6 | 6.0 | 13.0 | −5% |
| Example 13 | 1.9 | 5.5 | 13.0 | −5% |
| Example 14 | 1.7 | 5.5 | 13.0 | −5% |
| Example 15 | 1.9 | — | — | −5% |
| Example 16 | 1.8 | — | — | −5% |
| Example 17 | 1.7 | — | — | −5% |
| Comparative Example 1 | 1.4 | 5.0 | 12.0 | −30% |
| Comparative Example 2 | 1.2 | 4.5 | 11.0 | −5% |
| Comparative Example 3 | 1.9 | 7.0 | 17.0 | −20% |
| Comparative Example 4 | 1.5 | 7.0 | 17.0 | −5% |
| Comparative Example 5 | 1.9 | 16.0 | 30.0 | −5% |
| Comparative Example 6 | 1.5 | 16.0 | 30.0 | −15% |
| Comparative Example 7 | 2.3 | 20.0 | 45.0 | −5% |
| Comparative Example 8 | 2.0 | 12.0 | 24.0 | −5% |
| Comparative Example 9 | 1.9 | 15.0 | 30.0 | −5% |

Example 18

(a) Preparation of thermal cyan dye transfer sheet

An ink obtained by mixing and stirring 80 parts of Dye 4-1 (dye of the formula (6) wherein —B— is —COO—, and $R^{17}$, $R^{18}$ and $R^{19}$ are ethyl groups, and $R^{20}$ is a chlorine atom, and $R^{21}$ and $R^{22}$ are methyl groups), 100 parts of phenoxy resin (tradename: PKHH manufactured by Union Carbide Co.), 125 parts of methyl ethyl ketone, 450 parts of toluene and 300 parts of tetrahydrofuran (THF), was coated and dried on a polyester film of 6 μm by a bar coater so as to provide a dry film thickness of 1 μm, thereby forming a cyan dye layer.

On the back side of the sheet thus obtained, was coated a mixture solution of 10 parts by weight of acrylic resin (tradename: BR-100 manufactured by Mitsubishi Rayon K.K.), 1 part by weight of amino-modified silicone oil (tradename: KF 393 manufactured by Shin-Etsu Kagaku K.K.) and 89 parts by weight of toluene by a bar coater to provide a dry film thickness of 1 μm, thus providing a heat-resistant layer.

(b) Preparation of thermal yellow dye transfer sheet

An ink obtained by mixing and stirring 90 parts of Dye 1-1 (dye of the formula (1) wherein $R^1$ and $R^2$ are phenyl groups and $R^3$ and $R^4$ are methyl groups), 100 parts of phenoxy resin (tradename: PKHH manufactured by Union Carbide Co.), 125 parts of methyl ethyl ketone, 450 parts of toluene and 300 parts of tetrahydrofuran (THF), was coated on a polyester film of 6 μm by a bar coater, and dried so as to provide a dry film thickness of 1 μm, thereby forming a yellow dye layer.

In the same manner as in the above paragraph (a), on the back side of the sheet thus obtained, was coated a mixture solution of 10 parts by weight of acrylic resin (tradename: BR-100 manufactured by Mitsubishi Rayon K.K.), 1 part by weight of amino-modified silicone oil (tradename: KF 393 manufactured by Shin-Etsu Kagaku K.K.) and 89 parts by weight of toluene by a bar coater, so as to provide a dry film thickness of 1 μm, thus providing a heat-resistant lubricating layer.

(c) Preparation of image-receiving sheet

A solution obtained by mixing and stirring 70 parts of polyvinylphenylacetal resin, 25 parts of vinylchloride/vinyl acetate/vinyl alcohol copolymer resin (tradename: Esrec A manufactured by Sekisui Kagaku K.K.), 40 parts of modified silicone varnish (tradename: TSR-160 (solid content concentration 60%) manufactured by Toshiba Silicone K.K.), 3 parts of amino-modified silicone oil (tradename: KF 393 manufactured by Shin-Etsu Kagaku K.K.), 10 parts of a hexamethylene diisocyanate type polyfunctional isocyanate compound (tradename: Mitech NY-710A (solid content concentration 75%) manufactured by Mitsubishi Chemical Co.), 500 parts of methyl ethyl ketone and 500 parts of toluene, was coated on a polypropylene-made synthetic paper of a thickness of 150 μm (tradename: Yupo FPG150 manufactured by Oji Yuka Goseishi K.K.) by a wire bar, and dried (dry film thickness about 5 μm), and was further heat-treated in an oven at 80° C. for 12 hours to obtain an image-receiving sheet.

The above polyvinylphenylacetal resin was obtained by acetalizing polyvinyl alcohol (saponification value 99 mol %, polymerization degree: 1,700) with phenylacetaldehyde, and had a structure of the above-mentioned structural formula (1).

(d) Print recording

The dye layer of each of the thermal dye transfer sheets prepared as described in the above paragraphs (a) and (b) was brought into contact with the resin coating surface of the image-receiving sheet prepared as described in the above paragraph (c), and printing was made by using a part glaze type line thermal head having a density of 5.6 dots/mm under conditions of a conveying speed of 6 lines (dots)/mm in the conveying direction, a printing speed of 16.6 ms/line and an applied electric power of 0.20 W/dot. The time applied to the head per line for printing was 12 ms. By this method, a cyan-printed matter and a yellow-printed matter were obtained, and a green color-printed matter was obtained by over printing a cyan color on a yellow-printed matter.

(e) Measurement of density and color

A deep color density of the printed matter printed as described in the above paragraph (d) was measured by a reflective densitometer (tradename: Macbeth RD-920 type containing a filter having a SPI spectral sensitivity, manufactured by Macbeth Co.). As this result, an optical density of the cyan-printed matter was 2.0 and an optical density of the yellow-printed matter was 1.6.

Further, a chrominance value of each color was measured by using a chrominance-meter having an optical system in accordance with JIS Z-8722 (tradename: Spectral chrominance-meter SZ-Σ80 manufactured by Nihon Denshi Kogyo K.K.) under conditions of a C-light source and a visual field angle of 2°, and the measured value was expressed by CIELAB color system.

(f) Weather-resistance test

A deep color sample of the printed matter printed as described in the above paragraph (d) was subjected to a light-resistance test for 48 hours at an illuminance of 3.5 kw/$m^2$ by using a xenon lamp light-resistance tester (tradename: Atlas Ci35A Weatherometer manufactured by Toyo Seiki Seisakusho K.K.). A chrominance value of the printed matter was measured before and after the light-resistance test by using the same chrominance-meter under the same conditions as used in the above paragraph (e). A color difference (ΔEab*) in CIELAB color system was 8.0 with regard to the cyan color, 5.0 with regard to the yellow color and 11.0 with regard to the green color. Thus, the measured color differences were satisfactorily small.

Examples 19 to 25

The same test as in Example 18 was repeated, except that such combinations of dyes as shown in the following Table 3 were used in place of the combination of dyes used in Example 18. The results are shown in the following Table 4. It was proved from these results that the density was satisfactorily high and the light-resistance was also satisfactory.

TABLE 3

| | Pyrazolonemethine type dye | Indoaniline type dye |
|---|---|---|
| Example 18 | Dye No. 1-1 90 parts | Dye No. 4-1 80 parts |
| Example 19 | Dye No. 1-2 80 parts | Dye No. 4-2 80 parts |
| Example 20 | Dye No. 1-5 90 parts | Dye No. 4-3 80 parts |
| Example 21 | Dye No. 1-7 80 parts | Dye No. 4-4 90 parts |
| Example 22 | Dye No. 1-3 100 parts | Dye No. 4-5 70 parts |
| Example 23 | Dye No. 1-6 80 parts | Dye No. 4-6 80 parts |
| Example 24 | Dye No. 1-4 90 parts | Dye No. 4-7 90 parts |
| Example 25 | Dye No. 1-1 90 parts | Dye No. 4-8 80 parts |

Dyes 4-1 to 4-8 used in respective Examples are indoaniline type dyes having the following structural formulas.

Dye 4-1

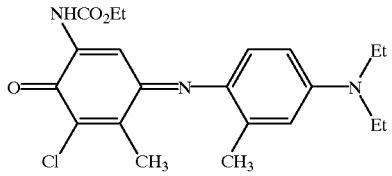

Dye 4-2

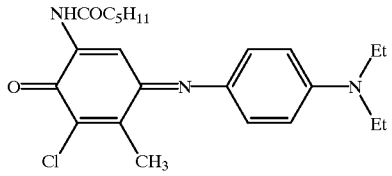

Dye 4-3

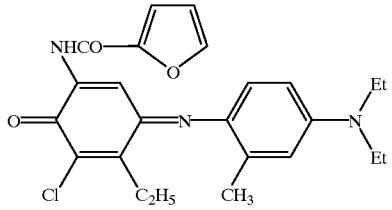

-continued

Dye 4-4

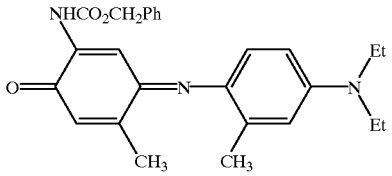

Dye 4-5

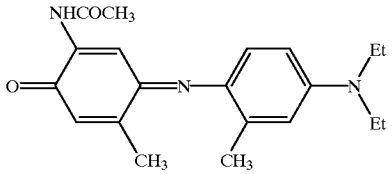

Dye 4-6

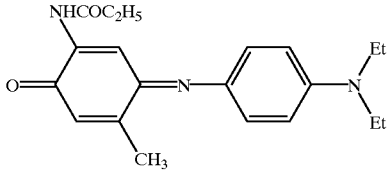

Dye 4-7

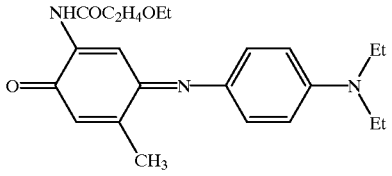

Dye 4-8

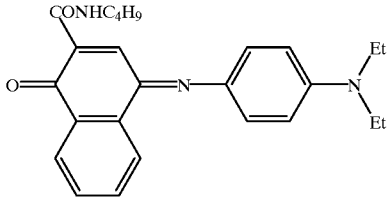

Comparative Example 10

The same test as in Example 18 was repeated, except that an anthraquinone type cyan dye of the following structural formula was used in place of Dye 4-1 used in the paragraph (a) of Example 18. An optical density was 1.5 and was proved to be unsatisfactorily low. The light-resistance was also unsatisfactory. The results are shown in the following Table 4.

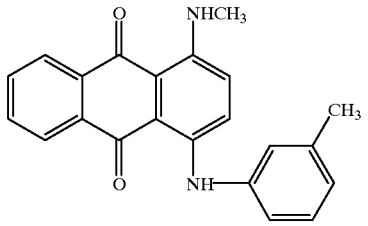

Comparative Example 11

The same test as in Example 18 was repeated, except that 70 parts of a styryl type dye of the following structural formula was used in place of Dye 1-1 used in the paragraph (b) of Example 18. The transferred density of yellow color was satisfactorily high, but the light-resistance, particularly the light-resistance of green color was unsatisfactory. This is considered to be due to the influence by catalytic fading phenomenon. The results are shown in the following Table 4.

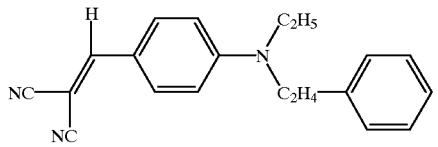

Comparative Example 12

The same test as in Example 18 was repeated, except that a quinophthalone type yellow dye of the following structural formula was used in place of Dye 1-1 used in the paragraph (b) of Example 18. At this time, since it was proved that a solubility of the dye in a coating solution for a dye layer was insufficient, a solvent was added and the transparent coating solution thus prepared was coated to form a dye layer. The dye layer thus formed was opaque and precipitation of the dye was recognized. The transferred yellow density was unsatisfactory. The results are shown in the following

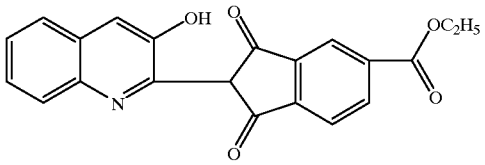

Comparative Example 13

The same test as in Example 18 was repeated, except that Dye 4-1 used in the paragraph (a) of Example 18 was replaced by an indoaniline type dye of the formula (6) (—B— is —CO—, $R^{17}$ is a pentyl group, $R^{18}$ and $R^{19}$ are ethyl groups, $R^{20}$ is a chlorine atom, $R^{21}$ is a methyl group and $R^{22}$ is a hydrogen atom) and Dye 1-1 used in the above paragraph (b) was replaced by a quinophthalone type yellow dye of the following structural formula. In the cyan dye layer, the dye was slightly precipitated. Since the quinophthalone type yellow dye was proved to be poor in solubility in a dye layer coating solution, a solvent was added thereto to prepare a transparent coating solution which was then coated to form a dye layer. The dye layer thus formed was opaque, and precipitation of the dye was recognized. The transferred yellow density was unsatisfactory. The results are shown in the following Table 4.

This combination of the dyes is the same combination as used in Example 1-4 of JP-A-63-71393.

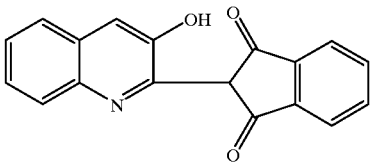

Comparative Example 14

The same test as in Example 18 was repeated, except that a pyridone azo type yellow dye of the following structural formula was used in place of Dye 1-1 used in the paragraph (b) of Example 18. The yellow density was 2.1 and was proved to be satisfactorily high. With regard to the light-resistance, a measured color difference (ΔEab*) of mixed color (green) was 24.0, thus providing an unsatisfactory result. It is considered that this is not only due to the unsatisfactory light-resistance of monocolor but also due to the degradation of the light-resistance of green color by catalytic fading phenomenon.

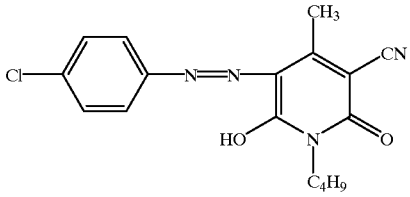

TABLE 4

| | Density (OD) | | Light-resistance (ΔE) | | |
|---|---|---|---|---|---|
| | Cyan | Yellow | Cyan | Yellow | Green |
| Example 18 | 2.0 | 1.7 | 8.0 | 5.0 | 11.0 |
| Example 19 | 2.1 | 1.8 | 8.0 | 5.0 | 10.0 |
| Example 20 | 1.8 | 1.6 | 9.0 | 5.0 | 12.0 |
| Example 21 | 2.2 | 1.6 | 9.0 | 6.0 | 12.0 |
| Example 22 | 2.2 | 1.8 | 7.0 | 7.0 | 11.0 |
| Example 23 | 2.4 | 1.6 | 7.0 | 5.0 | 10.0 |
| Example 24 | 2.2 | 1.8 | 8.0 | 5.0 | 10.0 |
| Example 25 | 1.5 | 1.7 | 11.0 | 5.0 | 15.0 |
| Comparative Example 10 | 1.5 | 1.7 | 15.0 | 5.0 | 20.0 |
| Comparative Example 11 | 2.0 | 2.4 | 8.0 | 20.0 | 40.0 |
| Comparative Example 12 | 2.0 | 1.4 | 8.0 | 3.0 | 10.0 |
| Comparative Example 13 | 1.8 | 1.1 | 8.0 | 3.0 | 10.0 |
| Comparative Example 14 | 2.0 | 2.1 | 8.0 | 12.0 | 24.0 |

As mentioned above, according to the present invention, a thermal dye transfer sheet having a yellow dye layer excellent in sensitivity, fastness such as light-resistance, shelf stability, coloring density and color reproducibility can be provided.

We claim:

1. A thermal dye transfer sheet having a dye layer provided on at least one side of a substrate, which is used for thermal dye transfer recording system carrying out recording by transferring a dye or dyes in the dye layer to a dye-receiving material by heating means, wherein the dye layer contains a pyrazolonemethine dye of the following formula:

(1)

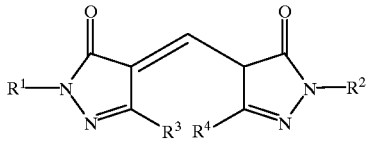

wherein $R^1$ and $R^2$ can be respectively independently selected and are a lower alkyl group which may be substituted, a lower alkenyl group which may be substituted or an aryl group which may be substituted; and $R^3$ and $R^4$ can be respectively independently selected and are a lower alkyl group which may be substituted, a dialkylamino group, a —$COOR^5$ group or a —$CONR^6R^7$ group, in which $R^5$ is a lower alkyl group which may be substituted, a lower alkenyl group which may be substituted or an aryl group which may be substituted and $R^6$ and $R^7$ can be respectively independently selected and are a hydrogen atom, a lower alkyl group which may be substituted, a lower alkenyl group which may be substituted or an aryl group which may be substituted.

2. The thermal dye transfer sheet according to claim 1, wherein in the pyrazolonemethine dye of the formula (1), $R^1$ and $R^2$ can be respectively independently selected and are a lower alkyl group, a phenyl group which may be substituted with a methyl group, methyl groups, a halogen atom or halogen atoms, or a benzyl group, $R^3$ and $R^4$ can be respectively independently selected and are a lower alkyl group or a —$COOR^5$ group in which $R^5$ is a lower alkyl group, a phenyl group which may be substituted with a methyl group, methyl groups, a halogen atom or halogen atoms, or a benzyl group.

3. The thermal dye transfer sheet according to claim 1, wherein in the pyrazolonemethine dye of the formula (1), $R^1$ and $R^2$ can be respectively independently selected and are a phenyl group or a tolyl group, and $R^3$ and $R^4$ are a methyl group.

4. The thermal dye transfer sheet according to claim 1, wherein in the pyrazolonemethine dye of the formula (1), $R^1$ and $R^2$ are a phenyl group, and $R^3$ and $R^4$ are a methyl group.

5. The thermal dye transfer sheet according to claim 1, wherein the dye layer further contains a pyrazoloneazo dye.

6. The thermal dye transfer sheet according to claim 5, wherein the pyrazoloneazo dye is a pyrazoloneazo dye of the following formula (2):

(2)

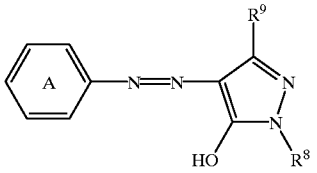

wherein A is a phenyl group which may be substituted, $R^8$ is a lower alkyl group which may be substituted, a lower alkenyl group which may be substituted or an aryl group which may be substituted, and $R^9$ is a lower alkyl group which may be substituted or a —$COOR^{10}$ group in which $R^{10}$ is a lower alkyl group which may be substituted, a lower alkenyl group which may be substituted or an aryl group which may be substituted.

7. The thermal dye transfer sheet according to claim 6, wherein in the pyrazolonemethine dye of the formula (1), $R^1$ and $R^2$ can be respectively independently selected and are a lower alkyl group, a phenyl group which may be substituted with a methyl group, methyl groups, a halogen atom or halogen atoms, or a benzyl group, and $R^3$ and $R^4$ can be respectively independently selected and are a lower alkyl group or a —$COOR^5$ group in which $R^5$ is a lower alkyl group, a phenyl group which may be substituted with a methyl group, methyl groups, a halogen atom or halogen atoms, or a benzyl group; and in the pyrazoloneazo dye of the formula (2), the substituent for A is at least one member selected from the group consisting of a hydrogen atom, a fluorine atom, a chlorine atom, a bromine atom, a nitro group, a cyano group and a methyl group, and $R^8$ is a lower alkyl group or a phenyl group which may be substituted with a halogen atom, halogen atoms, or a methyl group or methyl groups, and $R^9$ is a methyl group.

8. The thermal dye transfer sheet according to claim 6, wherein in the pyrazolonemethine dye of the formula (1), $R^1$ and $R^2$ are a phenyl group, and $R^3$ and $R^4$ are a methyl group; and in the pyrazoloneazo dye of the formula (2), A is a phenyl group, $R^8$ is a phenyl group and $R^9$ is a methyl group.

9. The thermal dye transfer sheet according to claim 1, wherein the dye layer further contains a quinophthalone yellow dye.

10. The thermal dye transfer sheet according to claim 9, wherein the quinophthalone dye is a quinophthalone dye of the formula (3):

(3)

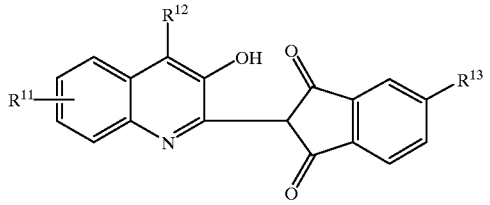

wherein $R^{11}$ is a hydrogen atom, a lower alkyl group which may be substituted, a halogen atom, an alkoxy group or an alkoxycarbonyl group, $R^{12}$ is a hydrogen atom, a halogen atom, an alkoxy group or a phenoxy group which may be substituted, $R^{13}$ is a halogen atom, a —$COOR^{14}$ group or a —$CONR^{15}R^{16}$ group, in which $R^{14}$ is an alkyl group which may be substituted, a lower alkenyl group which may be substituted or an aryl group which may be substituted, and $R^{15}$ and $R^{16}$ can be respectively independently selected and are a hydrogen atom, a lower alkyl group which may be substituted, a lower alkenyl group which may be substituted or an aryl group which may be substituted, provided that $R^{15}$ and $R^{16}$ can not be a hydrogen atom at the same time.

11. The thermal dye transfer sheet according to claim 10, wherein in the pyrazolonemethine dye of the formula (1), $R^1$ and $R^2$ can be respectively independently selected and are a lower alkyl group, a phenyl group which may be substituted with a methyl group, methyl groups, a halogen atom or halogen atoms, or a benzyl group, and $R^3$ and $R^4$ can be respectively independently selected and are a lower alkyl group or a —$COOR^5$ group in which $R^5$ is a lower alkyl group, a phenyl group which may be substituted with a methyl group, methyl groups, a halogen atom or halogen atoms, or a benzyl group; and the quinophthalone dye of the formula (3) is a quinophthalone dye of the following formula (4):

(4)

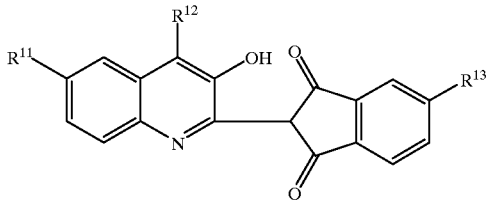

wherein $R^{11}$ is a hydrogen atom or a $C_1$–$C_4$ alkyl group, $R^{12}$ is a hydrogen atom or a halogen atom, and $R^{13}$ is a —$COOR^{14}$ group or a —$CONR^{15}R^{16}$ group, in which $R^{14}$ is a $C_3$–$C_{12}$ alkyl group which may be substituted or a phenyl group which may be substituted, and $R^{15}$ and $R^{16}$ can be respectively independently selected and are a lower alkyl group or an aryl group which may be substituted.

12. The thermal dye transfer sheet according to claim 11, wherein in the pyrazolonemethine dye of the formula (1), $R^1$ and $R^2$ are independently a methyl group, an ethyl group, a propyl group, a butyl group, a phenyl group or a tolyl group, and $R^3$ and $R^4$ are independently a methyl group or a —$COOR^5$ group in which $R^5$ is an ethyl group, a propyl group or a butyl group; and in the quinophthalone dye of the formula (4), $R^{11}$ is a hydrogen atom or a $C_1$–$C_4$ alkyl group, $R^{12}$ is a hydrogen atom or a bromine atom, and $R^{13}$ is a —$COOR^{14}$ group or a $CONR^{15}R^{16}$ group, in which $R^{14}$ is a $C_3$–$C_8$ alkyl group or a $C_3$–$C_8$ alkoxyethyl group, and $R^{15}$ and $R^{16}$ are independently a $C_2$–$C_8$ alkyl group.

13. The thermal dye transfer sheet according to claim 1, wherein the dye layer comprises a plurality of layers provided on one side of a substrate, and at least one dye layer contains the pyrazolonemethine yellow dye and at least one of the other dye layers contains an indoaniline cyan dye.

14. The thermal dye transfer sheet according to claim 13, wherein the indoaniline dye is a dye of the following formula (5):

(5)

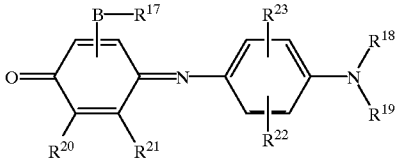

wherein —B— is —CONH—, —NHCO—, —NHCOO— or —$NHSO_2$—, and $R^{17}$ is a lower alkyl group which may be substituted, a lower alkenyl group which may be substituted, an aryl group which may be substituted, an aralkyl group which may be substituted or a heterocyclic ring which may be substituted with an alkyl group or a halogen atom, and $R^{18}$ and $R^{19}$ are independently a lower alkyl group which may be substituted, and $R^{20}$ is a hydrogen atom or a halogen atom, $R^{21}$ is a halogen atom or an alkyl group which may be substituted or an acylamino group, and $R^{22}$ is a hydrogen atom, a methyl group, an acylamino group, an alkoxycarbonylamino group or an alkylsulfonylamino group, and $R^{23}$ is a hydrogen atom or a methyl group, and $R^{20}$ and $R^{21}$ may be connected to form a 6-membered aromatic ring which may contain a heteroatom.

15. The thermal dye transfer sheet according to claim 14, wherein the indoaniline dye of the formula (5) is a dye of the following formula (6):

(6)

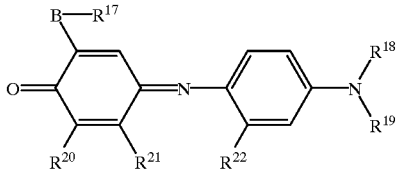

wherein —B— is —NHCO— or —NHCOO—, $R^{17}$ is a lower alkyl group which may be substituted, a lower alkenyl group which may be substituted, an aryl group which may be substituted, an aralkyl group which may be substituted or a heterocyclic ring which may be substituted with an alkyl group or a halogen group, $R^{18}$ and $R^{19}$ are independently a lower alkyl group which may be substituted, and $R^{20}$ is a hydrogen atom or a halogen atom, and $R^{21}$ is a methyl group or an ethyl group, and $R^{22}$ is a hydrogen atom or a methyl group.

16. The thermal dye transfer sheet according to claim 15, wherein in the pyrazolonemethine dye of the formula (1), $R^1$ and $R^2$ are independently a lower alkyl group, an aryl group which may be substituted or an aralkyl group, and $R^3$ and $R^4$ are independently a lower alkyl group or a —$COOR^5$ group in which $R^5$ is a lower alkyl group, an aryl group which may be substituted or an aralkyl group; and in the indoaniline dye of the formula (6), —B— is —NHCO— or —NHCOO—, and $R^{17}$ is a lower alkyl group, a lower alkenyl group, a $C_7$–$C_{10}$ aralkyl group, a $C_6$–$C_{10}$ aryl group, a chloroethyl group, a lower alkoxy lower alkyl group, a tetrahydrofurfuryl group, a $C_9$–$C_{12}$ aralkyloxyethyl group, a $C_8$–$C_{12}$ aryloxyethyl group, a lower alkenyloxyethyl group, a tetrahydrofurfuryloxyethyl group or a heterocyclic ring containing O, N or S as a hetero-atom, and $R^{18}$ and $R^{19}$ are a methyl group or an ethyl group, and $R^{20}$ is a hydrogen atom or a chlorine atom, $R^{21}$ is a methyl group or an ethyl group and $R^{22}$ is a hydrogen atom or a methyl group.

17. The thermal dye transfer sheet according to claim 15, wherein in the pyrazolonemethine dye of the formula (1), $R^1$ and $R^2$ are a methyl group, an ethyl group, a propyl group, a butyl group, a phenyl group or a tolyl group, and $R^3$ and $R^4$ are independently a methyl group or a —$COOR^5$ group in which $R^5$ is an ethyl group, a propyl group or a butyl group; and in the indoaniline dye of the formula (6), —B— is —NHCO— or —NHCOO—, and $R^{17}$ is a lower alkyl group, a lower alkenyl group, a phenyl group, a tolyl group, a benzyl group, a tetrahydrofurfuryl group, a lower alkoxy lower alkyl group, furan, pyridine or thiophene, and $R^{18}$ and $R^{19}$ are an ethyl group, and $R^{20}$ is a hydrogen atom or a chlorine atom, $R^{21}$ is a methyl group or an ethyl group, and $R^{22}$ is a hydrogen atom or a methyl group.

18. A method for thermal dye transfer recording which comprises using a thermal dye transfer sheet having a dye layer provided on at least one side of a transferring an image to an image-receiving sheet, wherein a pyrazolonemethine dye is used as a yellow dye and an indoaniline cyan dye is used as a cyan dye, wherein the pyrazolonemethine dye is of the formula

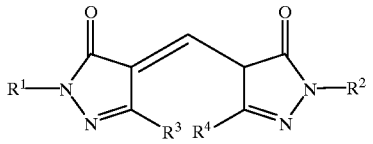

wherein $R^1$ and $R^2$ can be respectively independently selected and are a lower alkyl group which may be substituted, a lower alkenyl group which may be substituted or an aryl group which may be substituted; and $R^3$ and $R^4$ can be respectively independently selected and are a lower alkyl group which may be substituted, a dialkylamino group, a —$COOR^5$ group or a —$CONR^6R^7$ group, in which $R^5$ is a lower alkyl group which may be substituted, a lower alkenyl group which may be substituted or an aryl group which may be substituted and $R^6$ and $R^7$ can be respectively independently selected and are a hydrogen atom, a lower alkyl group which may be substituted, a lower alkenyl group which may be substituted or an aryl group which may be substituted.

19. The method according to claim 18, wherein the pyrazolonemethine dye is a dye of the following formula (1):

(1)

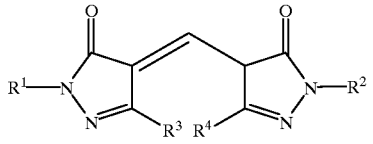

wherein $R^1$ and $R^2$ are independently a lower alkyl group, a phenyl group which may be substituted with a methyl group or a halogen atom, or a benzyl group, and $R^3$ and $R^4$ are a lower alkyl group or a —$COOR^5$ group in which $R^5$ is a lower alkyl group, a phenyl group which may be substituted with a methyl group, methyl groups, a halogen atom or halogen atoms, or a benzyl group; and the indoaniline cyan dye is a dye of the following formula (6):

(6)

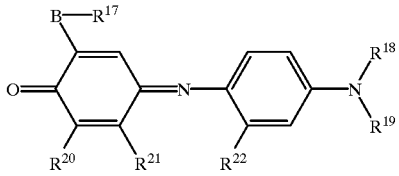

wherein —B— is —NHCO— or —NHCOO—, $R^{17}$ is a lower alkyl group, a lower alkenyl group, a phenyl group, a tolyl group, a benzyl group, a tetrahydrofurfuryl group, a lower alkoxy lower alkyl group, furan, pyridine or thiophene, $R^{18}$ and $R^{19}$ are an ethyl group, $R^{21}$ is a methyl group or an ethyl group, $R^{22}$ is a hydrogen atom or a methyl group, and $R^{20}$ is a hydrogen atom or a chlorine atom.

* * * * *